United States Patent [19]

McClelland

[11] 3,964,811

[45] June 22, 1976

[54] TENSION ROD CABINET SYSTEMS

[75] Inventor: Robert G. McClelland, Grand Rapids, Mich.

[73] Assignee: E. H. Sheldon and Company, Muskegon, Mich.

[22] Filed: Feb. 20, 1975

[21] Appl. No.: 551,336

[52] U.S. Cl. ..... 312/265; 312/257 R

[51] Int. Cl.[2] ..... A47B 48/00

[58] Field of Search ..... 52/223, 230, 483, 488, 52/731, DIG. 8; 312/108, 111, 257, 262–265

[56] References Cited

UNITED STATES PATENTS

| | | | |
|---|---|---|---|
| 1,251,720 | 1/1918 | Wege | 312/265 X |
| 1,631,718 | 6/1927 | Campbell | 312/257 SK |
| 1,854,345 | 4/1932 | Morin | 312/263 |
| 2,152,374 | 3/1939 | Burr, Jr. | 52/223 R X |
| 3,786,765 | 1/1974 | Burr | 312/257 R |
| 3,879,096 | 4/1975 | Blodee | 312/265 |

FOREIGN PATENTS OR APPLICATIONS

| | | | |
|---|---|---|---|
| 847,757 | 7/1970 | Canada | 312/265 |

*Primary Examiner*—Paul R. Gilliam
*Assistant Examiner*—C. F. Pietruszka
*Attorney, Agent, or Firm*—Dawson, Tilton, Fallon & Lungmus

[57] ABSTRACT

A stretcher rail assembly for securing side panels and separator panels in a cabinet includes a modified C-shaped channel rail with stiffened flanges formed from light gauge metal. The forward portion of the channel has a continuous, elongated opening for permitting access to the interior of the rail in attaching the web to a wall. One of the stiffeners has an outwardly extending fastening flange adjacent the access opening, and it may be used to locate, secure, or support cabinet tops, bottoms, support bases, partition panels or casters. Each rail is provided with end spacer plates provided with top and bottom welding flanges to prevent opening of the rail under load. The spacer plates are apertured to locate a tension rod in the center of the channel and act to transmit load from the rail to the rod and thence to the cabinet walls. Projections are provided on the spacer plate weld flanges for biting into the side panels they engage to prevent rotation of the rails.

14 Claims, 9 Drawing Figures

Fig. 5
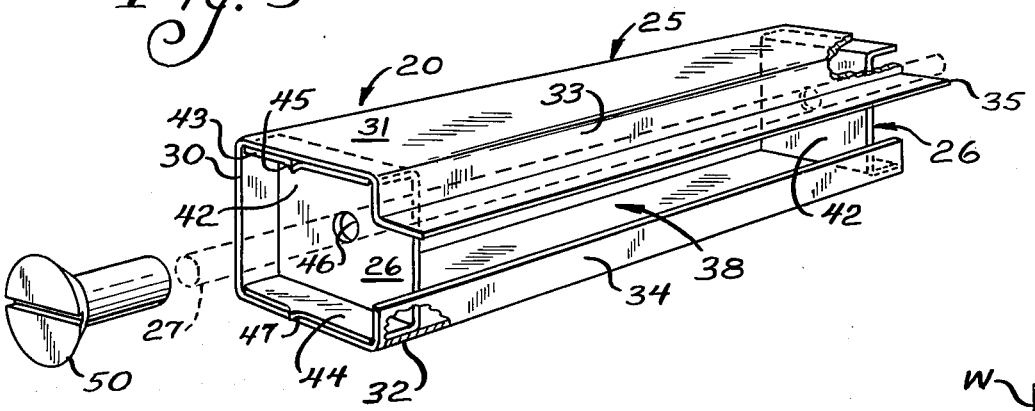
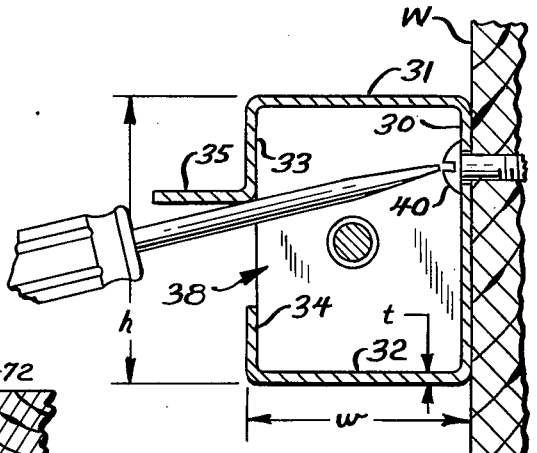
Fig. 6
Fig. 7
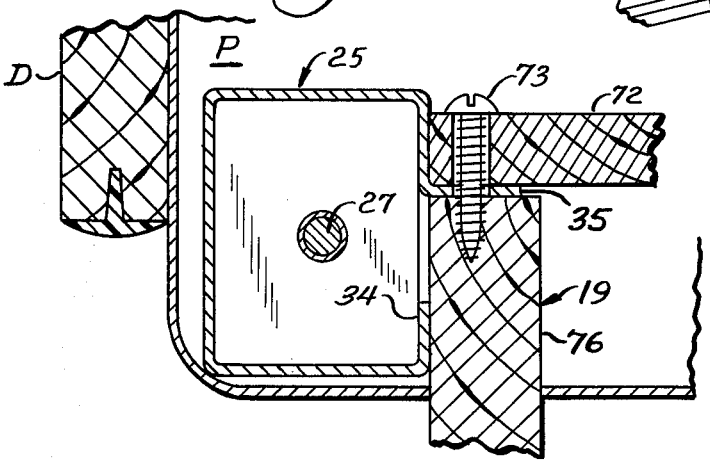
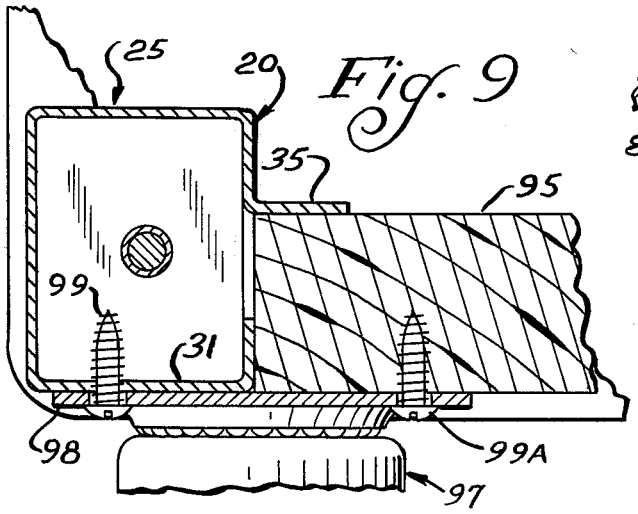
Fig. 9
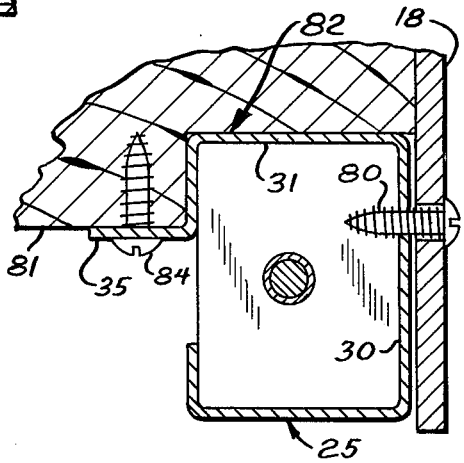
Fig. 8

TENSION ROD CABINET SYSTEMS

BACKGROUND AND SUMMARY

The present invention relates to modular cabinet systems, and particularly to cabinet systems wherein the cabinets may be provided in units defined by separator panels which, together with end panels are held together by spacer bars and tension rods such as disclosed in the patent application of Leif Blodee, Ser. No. 338,548, filed Mar. 6, 1973, now U.S. Pat. No. 3,879,096 for "Cabinet Systems with Tension Rods as Frame Members." More particularly, the present invention relates to improvements in the stretcher rail assembly through which the tension rod is received.

The stretcher rail of the above patent was disclosed as being an extruded aluminum structure, which, although useful, is expensive to make and somewhat complicated when used as a structural element for mounting cabinet tops, counter tops, bottom panels, and so on.

Briefly, the present invention provides a stretcher rail formed from light gauge metal into a modified C-shape with stiffened flanges. Further, one of the stiffening members or "stiffener" for short, includes an outwardly extending fastening flange, which provides additional stiffening to the beam. One side of the channel has a continuous, elongated opening for permitting access to the interior of the rail in attaching the web of the beam to a wall.

The fastening flange may be used to locate, secure or support cabinet tops, counter tops, bottom panels, support bases, partition panels, casters, etc. Each rail is provided with end spacer plates having top and bottom welding flanges welded respectively to the upper and lower flanges of the rail. The spacer plates prevent opening of the rail under load and act to transmit load from the rail to the rod and thence to the cabinet walls.

The spacer plates are apertured to locate a tension rod in the center of the channel; and the channel shape of the rail has approximately the same depth as height so that the load is more evenly distributed throughout its entire cross section. Projections are provided on the spacer plate weld flanges for biting into the side panels they engage to prevent rotation of the rails after assembly.

In cabinetry of this type, there is a tendency, when load is applied, to collapse the cabinetry along a diagonal--that is, from a lower corner to a diagonally opposite upper corner, when viewed from front or rear--and this is sometimes called "parallelogramming." In order to prevent parallelogramming it is desirable to have the rails act as beams, and to provide maximum extension in height and depth of the rail cross section so that each rail engages an associated end panel or partition panel at two locations which are spaced apart as far as possible.

The present invention enables the use of light gauge sheet steel for the stretcher rails, and this enhances beam strength. Further, the channel shape of the beam with stiffening members enhances the vertical and horizontal extension of the beam to resist the parallelogramming tendency mentioned above with the least amount of material in the beam. This material, further, located as it is at a maximum distance from the center of the rail, adds still further strength to the beam.

The different and convenient uses to which the fastening flange may be put are illustrated in the accompanying detailed disclosure, but it should be notedthat the fastening flange also acts as an additional stiffening member for the beam.

It has been found that in some cases it is desirable to add strength to a cabinet unit (such as a wall-mounted cabinet) by adding a base during manufacture and removing the base at the installation site. With the present invention the fastening flanges may be used to secure an inexpensive, removable base which may be removed just prior to installation. The present invention is adaptable for use with many different types of cabinet material, such as wood, pressed board, plywood, and even metals. The stretcher rails may be fastened directly to a wall, or they may be fastened to other interiors for holding other separator panels. The rails may also be used to mount door clips or other hardware, such as drawer slides.

Thus, with the present invention, there is provided an improved stretcher rail assembly which is more economical, yet stronger and more useful than prior designs.

Other features and advantages of the present invention will be apparent to persons skilled in the art from the following detailed description of a preferred embodiment accompanied by the attached drawing wherein identical reference numerals will refer to like parts in the various views.

THE DRAWING

FIG. 5 is a perspective view of a stretcher rail incorporating the present invention;

FIG. 6 is a cross sectional view of a stretcher rail of FIG. 5 illustrating a method of mounting the rail to a wall;

FIG. 7 is an enlarged cross sectional view taken through a lower front stretcher rail showing the of of a support base;

FIG. 8 is an enlarged cross sectional view of a lower rear stretcher rail illustrating the attachment o a vertical partition; and FIG. 9 is an enlarged cross sectional view of a lower front stretcher rail illustrating the attachment of a caster.

DETAILED DESCRIPTION

Figure 1:
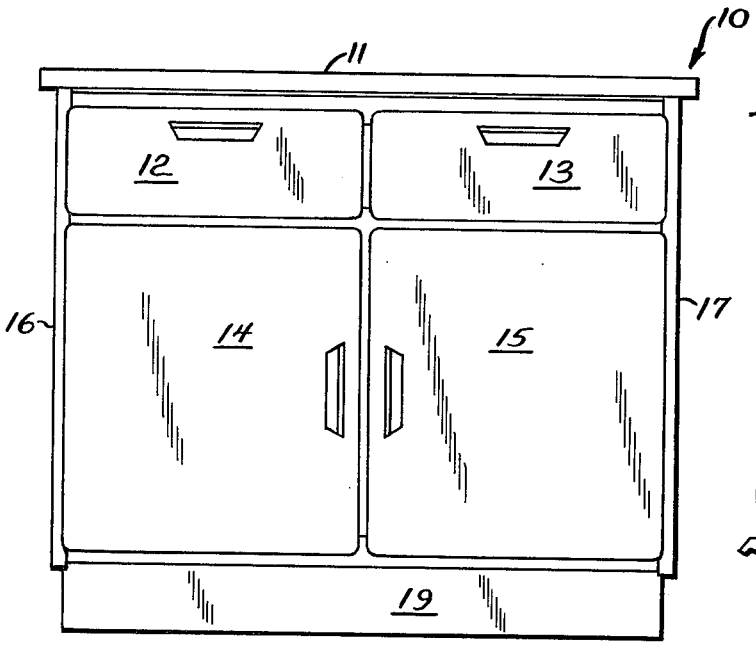
FIG. 1 is a front elevational view of a cabinet mounted on a floor base and incorporating the present invention.
Figure 2:
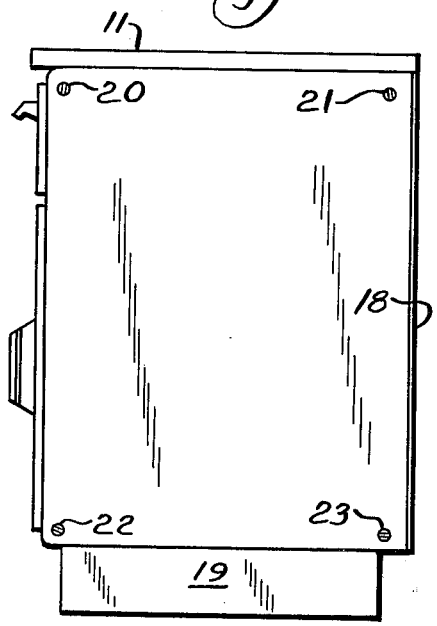
FIG. 2 is a side view of the cabinet of FIG. 1.

Referring first to FIG. 1, reference numeral 10 generally designates a cabinet structure having a counter top 11, upper left and right-hand drawers 12, 13, and lower left and right-hand doors 14, 15. The cabinet 10 further includes a left side panel 16, a right side panel 17, a rear panel 18 (FIG. 2). The embodiment of FIG. 1 also includes a base 19 since it is intended to be used as a floor-mounted cabinet-that is, the weight of the cabinet and contents is supported by the floor.

The sides 16, 17 as well as any intermediate partitions are held in place by four corner stretcher rail assemblies, located generally at the locations indicated respectively by reference numerals 20, 21, 22 and 23 in FIG. 2. The stretcher rails extend perpendicular to the plane of the page of FIG. 2.

Referring now to FIG. 5, there is shown in perspective one of the stretcher rail assemblies generally designated 20, it being understood that the others are similar to that which is shown in FIG. 5. The assembly 20 includes a stretcher rail 25, first and second spacer plates 26 (having a U-shape but turned on their sides), tension rod 27 (shown in phantom), and end ferrules, one of which is shown at 50.

Turning first to the stretcher rail 25, a stiffened steel channel made from light-gauge metal and fabricated to conform to AISI specifications for the design of cold-formed steel structural members. As used herein, "light gauge" refers to a thickness in the range 0.048 in. to 0.135 in.

The rail 25 has a general C-shaped cross section, as seen in FIGS. 5 and 6, including a rear web 30, upper and lower forwardly-extending flanges 31, 32 and forward stiffening members 33, 34 formed downwardly and upwardly respectively of flanges 31, 32. An additional stiffener 35 (sometimes referred to as a flange or fastening flange) extends from the lower end of the upper stiffener 33 hence, the term "modified C shape" is used to describe the cross-sectional shape of the rail. Thus, the lower edges of the upper stiffener 33 and the adjacent upper edge of the lower stiffener 34 are spaced apart to provide a continuous horizontally elongated access opening 38 which may be used, as seen in FIG. 6, for fastening a stretcher rail assembly to an upright wall designated W by means of a fastener, such as the screw designated 40. As will be disclosed presently, the lip or flange 35 may serve a number of purposes.

Returning to the assembly of FIG. 5, the end spacer plates 26 similar in structure, each including an upright plate portion 42 and laterally extending upper and lower welding flanges 43, 44 for welding respectively to the upper flange 31 and the lower flange 32 of the rail 25. The plate 42 is also apertured at its center, as at 46, to receive the tension rod 27 in a tolerance fit (see FIGS. 7 and 9) and which extends from side to side of a cabinet unit.

Each of the welding flanges 43, 44 is provided with a center, pointed projection designated respectively 45, 47. The purpose of projections 45, 47 is to bite into or form a detent in an adjacent upright side panel or separator panel of a cabinet unit to prevent rotation of the rail 25 about the tension rod 27. In other words, when load is applied to a cabinet unit, whether on the top or on an interior drawer structure, there is a tendency to rotate the rail 25 about the tension rod 27, and the projections 45, 47 by biting into and engaging the side of a panel with which it comes into contact, will prevent such rotation.

The side panels or intermediate separator panels for cabinet units are held in their upright positions by the stretcher rail assemblies 25, and the side panels are firmly held against the rails by means of end ferrules, one of which is shown in FIG. 5 and designated 50. The ferrule 50 is internally threaded, and the associated tension rod 27 is externally threaded. The threading may extend throughout the entire length of the rod.

The spacer plates 26 perform a number of functions, one function is to prevent further opening of the rail 25 under load. This is accomplished by welding the flanges of the plate to the top and bottom flanges of the channel rail, as described above. Another function of the end spacer plates, as also indicated above is to prevent rotation of the rail 25 about the tension rod 27. Still another function of the end spacer plates 26 is to hold the tension rod 27 in a predetermined position relative to the C-shaped modified stretcher rail 25--that is, the axis of the tension rod 27 preferably extends along the center of the channel formed by the rail 25, and is snugly received by the aperture spacer plate 26. In this manner, load transmitted to the end or separator panels from the stretcher rail assemblies is evenly distributed throughout the C-shape of the rail 25.

In the design of the rail 25, the overall flat-width ratio w/t, disregarding intermediate stiffeners and taking the actual thickness, $t$, of the sheet material, is less than 60 and preferably in the range of 20-60--where $w$ is the width of the upper and lower flanges 31, 32 (see FIG. 6).

Further, the maximum allowable web-to-depth ratio $h/t$, of the rails is 150, with a preferred range of 30-60---where again $t$ is again the thickness of the sheet material, and $h$ represents the height of the web 30.

Referring now to the horizontally extending lip or flange 35, it serves a number of different functions, including a means for mounting a counter top to a stretcher rail assembly (FIG. 3), a means of mounting a conventional cabinet top to the stretcher rail assembly (FIG. 4), a means for mounting a cabinet base or a cabinet bottom to the stretcher rail assembly (FIG. 7), a means for mounting an intermediate partition to a stretcher rail assembly (FIG. 8), and a means for locating and securing a caster assembly beneath a cabinet (FIG. 9).

Figure 3:
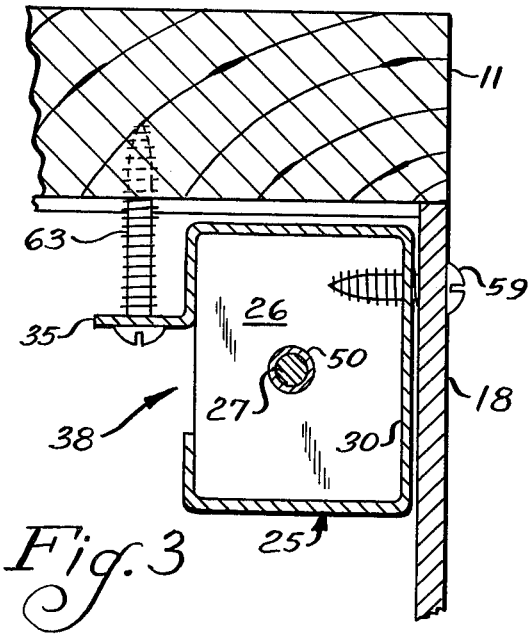
FIG. 3 is an enlarged cross sectional view taken transverse to a stretcher rail for the system of FIG. 1.

Referring then to FIG. 3, the stretcher rail assembly is again generally designated by reference numeral 20, the channel stretcher rail 25, and the horizontal, forwardly-extending flange is designated 35. In this embodiment, the back panel 18 is secured to the web 30 of the rail by means of a screw 59. The counter top 11 rests on the upper edges of the back panel 59 and the side panels; and a screw 63 extends through a hole in the flange 35 and is secured to the bottom of the counter top 11.

Figure 4:
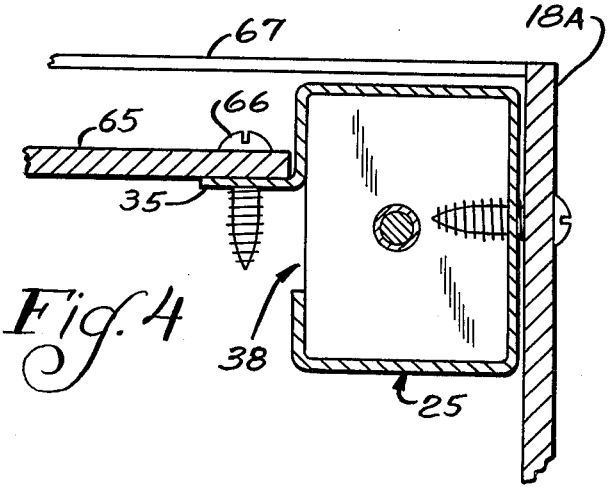
FIG. 4 is a view similar to FIG. 3 showing an alternative top panel.

In FIG. 4 the stretcher rail assembly 25 is again used for securing a back panel 18A. However, in this embodiment a thinner cabinet top 65 is sized so as to rest on the upper surface of the flange 35, and is secured to it by means of the screw 66. The far end wall is seen at 67. The thickness of the top 65 may, of course, be sufficient to make its upper surface flush with the upper surface of the stretcher rail 25, if desired.

Referring now to FIG. 7, a bottom panel 72 rests on and is supported on top of the outwardly extending flange 35 of the stretcher rail 25, and is secured to it by means of a screw 73. The rail 25 is shown here in inverted position, and it is located in the lower forward corner. The front 76 of a supporting base 19 extends upwardly adjacent the stiffener 34 and engages the undersurface of the flange 35, again being secured by the screw 73. Thus, the flange 35 may serve as a support for a bottom panel 72 as well as a positioning and attaching means for a peripheral support base 19, for a floor-mounted cabinet as seen in FIG. 1. In FIG. 7, P represents a partition or end panel (with trim) and D is a front door (also trimmed).

Referring now to FIG. 8, where the stretcher rail 25 is seen in a lower, rear position, again a back panel is designated 18, and a screw 80 is secured through the panel 18 to the web 30 of the rail 25. Reference numeral 81 designates a partition panel which is notched to fit over the stretcher, as at 82, resting on the upper surface of the flange 35 and secured to it by means of a screw 84. The horizontal portion of the notch 82 engages the upper surface of the horizontal flange 31 of the rail 25 for transferring load to it, the primary function of the screw 84 being to prevent lateral dislocation of the separator panel 81.

Referring now to FIG. 9, a stretcher rail assembly 20 is shown in a lower forward position, similar to FIG. 7, with the rail 25 again inverted. In this embodiment, a bottom panel for a cabinet is designated by reference numeral 95, and it is located beneath, and abuts, the lower surface of the flange 35. The thickness of the bottom panel 95 is sufficient so that its lower surface is approximately flush with the bottom surface of the rail 25. A caster generally designated by reference numeral 97 and including a mounting plate 98 is secured to the flange 31 of the rail 25 by means of a first screw 99, and to the cabinet bottom panel 95 by means of a second screw 99A. Thus, the fastening flange 35 serves to locate the cabinet bottom 95 to enable the caster assembly to be secured both to the bottom and to the stretcher rail assembly.

Having thus described in detail a preferred embodiment of the present invention and illustrating its many uses, persons skilled in the art will be able to modify certain of the structure which has been shown and to substitute equivalent elements for those disclosed while continuing to practice the principle of the invention; and it is, therefore, intended that all such modifications and substitutions be covered as they are embraced within the spirit and scope of the appended claims.

I claim:

1. In a cabinet system including at least two upright sidewalls of generally rectangular shape and a plurality of stretcher rail assemblies securing said sidewalls together at upper front, upper rear, lower front and lower rear corners thereof, each assembly including a stretcher rail and a tension rod, the improvement comprising: each of said stretcher rails being a channel rail of modified C shape with stiffened flanges formed of light gauge metal and defining a continuous elongated opening along one side for permitting access to the interior of the rail, and including an outwardly extending fastening flange extending along said opening; and a spacer plate located at each end of said rails and fixed to said rails, each spacer plate defining an aperture for snugly centrally receiving and positioning an associated tension rod, whereby load is transmitted from a rail through said spacer plates to the tension rod and thence to said cabinet side walls.

2. The apparatus of claim 1 wherein lack of said stretcher rails includes a web, first and second flanges extending from the respective ends of said web, first and second stiffening members extending toward each other and parallel to said web from the distal ends of said flanges and spaced from each other to define said access opening, said fastening flange extending in a plane transverse of the plane of said web and integral with one of said stiffening members at a location remote from its associated flange.

3. The apparatus of claim 2 wherein the ratio of the height, $h$, of said web to the thickness, $t$, of said light gauge metal is in the range of 30 to 60.

4. The apparatus of claim 3 wherein the width of said first and second flanges, $w$, to the thickness of said light gauge metal is in the range 20 to 60.

5. The apparatus of claim 2 wherein said spacer plates include flange means secured to said rail.

6. The apparatus of claim 5 wherein the tension rod aperture of said spacer plates is located such that the axis of said rod, when received therein, extends within the center of said rail.

7. The apparatus of claim 1 further comprising means for fastening the ends of said rod to said upright end panels to compress said rail against said end panel.

8. The apparatus of claim 1 further comprising a top to said cabinet; and means for securing said top to the fastening flange of at least one of said rails.

9. The apparatus of claim 8 further comprising a back panel on said cabinet and fastener means for securing said back panel to the web of said rail.

10. The apparatus of claim 1 wherein said rails include a pair of upper rails an a pair of lower rails and wherein said improvment further comprises a bottom panel to said cabinet unit; the fastening flanges of said lower rails extending inwardly; and means for securing said bottom panel to said fastening flanges of the lower rails.

11. The apparatus of claim 10 further comprising a base beneath said cabinet located within the lower rails thereof and extending upwardly to engage the fastening flanges of said lower rails and abutting at least one stiffening member of said lower rails.

12. The apparatus of claim 1 further comprising at least one separator panel in said cabinet unit, notched at its lower corners to fit over the lower rails, said notches being formed so that at least a portion of said separator panel extends adjacent the fastening flanges of said lower rails; and means for securing said separator panels to said fastening flanges of said lower rails.

13. The apparatus of claim 1 wherein the fastening flanges of each of the lower corner rails extends inwardly of the cabinet, said apparatus further comprising a bottom panel extending between said lower rails and beneath and abutting said fastening flanges; casters beneath said cabinet unit; and means for securing each caster to said bottom panel and to one of said rails.

14. The apparatus of claim 1 wherein said spacer plates each include first and second outwardly extending flanges, each flange defining a projection for biting into an adjacent panel.

* * * * *

UNITED STATES PATENT OFFICE

CERTIFICATE OF CORRECTION

Patent No. 3,964,811 Dated June 22, 1976

Inventor(s) Robert G. McClelland

It is certified that error appears in the above-identified patent and that said Letters Patent are hereby corrected as shown below:

In claim 2, column 5, line 51, "lack" should be --each--.

Signed and Sealed this

Seventh Day of September 1976

[SEAL]

*Attest:*

RUTH C. MASON
*Attesting Officer*

C. MARSHALL DANN
*Commissioner of Patents and Trademarks*